US005729900A

United States Patent [19]

Hara et al.

[11] Patent Number: 5,729,900

[45] Date of Patent: *Mar. 24, 1998

[54] METHOD OF MANUFACTURING A TAPPET IN AN INTERNAL COMBUSTION ENGINE

[75] Inventors: Nobuo Hara, Fujisawa; Tatsuo Kanzaki, Yamato, both of Japan

[73] Assignee: Fuji Oozx, Inc., Fujisawa, Japan

[ * ] Notice: The term of this patent shall not extend beyond the expiration date of Pat. No. 5,605,122.

[21] Appl. No.: 771,987

[22] Filed: Dec. 23, 1996

Related U.S. Application Data

[62] Division of Ser. No. 643,747, May 6, 1996, Pat. No. 5,605,122.

[51] Int. Cl.[6] ..... B23P 15/00

[52] U.S. Cl. ..... 29/888.43; 29/527.4

[58] Field of Search ..... 29/888.43, 527.4; 123/90.48, 90.51, 90.55; 74/569

[56] References Cited

U.S. PATENT DOCUMENTS

| | | | |
|---|---|---|---|
| 2,467,079 | 4/1949 | Corlett | 29/888.43 |
| 3,058,454 | 10/1962 | Goncdlues | 123/90.51 |
| 3,279,446 | 10/1966 | Rappa | 123/90.51 |
| 4,909,198 | 3/1990 | Shiraya et al. | 123/90.51 |
| 5,228,418 | 7/1993 | Doehring | 123/90.51 |
| 5,280,771 | 1/1994 | Groh et al. | 123/90.51 |

*Primary Examiner*—Irene Cuda

*Attorney, Agent, or Firm*—Hoffman, Wasson & Gitler

[57] ABSTRACT

A method of manufacturing a tappet which is used in an internal combustion engine of vehicles is provided. A core material of the tappet has a helical groove on the outer circumferential surface, and a wear resistant coating layer, the ends of which are chamfered. In the vicinity of the end of the core material the helical groove gradually becomes small toward the end, thereby preventing peaks of the helical groove from exposure to the outside.

4 Claims, 4 Drawing Sheets

METHOD OF MANUFACTURING A TAPPET IN AN INTERNAL COMBUSTION ENGINE

This is a divisional of application Ser. No. 08/643,747 filed on May 6, 1996, now U. S. Pat. No. 5,605,122.

BACKGROUND OF THE INVENTION

The present invention relates to a tappet in an internal combustion engine and a method of manufacturing it.

For example, to increase wear resistance of a conventional tappet, as shown in FIG. 8, a helical groove 13 is formed on the outer circumferential surface of raw material for a tappet to make a core material 15, the surface of which is thermally sprayed by wear resistant material such as Fe metal to form a coating layer 17 which covers the helical groove 13. The outer circumferential surface of the coating layer is ground to form a cylindrical portion 18, the end 19 of which is chamfered.

However, at the chamfered end of the tappet, as clearly shown in FIG. 9, the cylindrical wear resistant coating layer 17 in which the groove 13 of the core material 15 is embedded is slightly left as a fine string-like portion 16, which is likely to peel off as small pieces.

SUMMARY OF THE INVENTION

It is an object of the present invention to provide a tappet in an internal combustion engine in which a core material which has a helical groove on the outer circumferential surface is covered with wear resistant material, thereby preventing a fine string portion of a coating layer from peeling off at the chamfered end.

It is another object of the present invention to provide a method of manufacturing a tappet in an internal combustion engine economically.

According to one aspect of the present invention, there is provided a tappet in an internal combustion engine, the tappet comprising a core material having a helical groove on the outer circumferential surface and a wear resistant coating layer which covers the outer circumferential surface of the core material, the end of the outer circumferential surface being chamfered, characterized in that in the vicinity of the end of the outer circumferential surface, said helical groove gradually becomes smaller in diameter toward the end, thereby preventing peaks of the helical groove from being exposed over the outer circumferential surface of said coating layer.

According to another aspect of the present invention, there is provided a tappet in an internal combustion engine, the tappet comprising a core material having a helical groove on the outer circumferential surface and a wear resistant coating layer which covers the outer circumferential surface of the core material, the end of the outer circumferential surface being chamfered, characterized in that the end of said helical groove is terminated at a position slightly spaced from the end of the core, an annular groove being formed at the end of the helical groove, thereby preventing peaks of the helical groove from being exposed over the outer circumferential surface of said coating layer.

According to a further aspect of the present invention, there is provided a tappet in an internal combustion engine, the tappet comprising a core material having a helical groove on the outer circumferential surface and a wear resistant coating layer which covers the outer circumferential surface of the core material, the end of the outer circumferential surface being chamfered, characterized in that the vicinity of the end of the outer core circumferential surface, said helical groove gradually becomes smaller in diameter toward the end, the end of said helical groove is terminated at a position slightly spaced from the end of the core, an annular groove being formed at the end of the helical groove, thereby preventing peaks of the helical groove from being exposed over the outer circumferential surface of said coating layer.

According to yet another aspect of the present invention, there is provided a method of manufacturing a tappet in an internal combustion engine, the method comprising the steps of forming a helical groove on the outer circumferential surface of a core material so that the groove may become smaller in diameter in the vicinity of the end of the core material; covering the outer circumferential surface with a wear resistant coating layer; and forming the outer circumferential surface to an cylindrical surface, at least the end of the cylindrical surface being chamfered.

According to a still further aspect of the present invention, there is provided a method of manufacturing a tappet in an internal combustion engine, the method comprising the steps of contacting the outer circumferential surface of a cylindrical core material with a cutting tool to give feed in an axial direction to form a helical groove on the outer circumferential surface of the core material while the core material is rotated on an axis; stopping the feed of the cutting tool when the helical groove reaches in the vicinity of the end of the core material to form an annular groove at the end of the helical groove; overing the outer circumferential surface of the core material with wear resistant coating layer; and finishing the outer circumferential surface to a cylindrical surface, at least the end of the cylindrical surface being chamfered.

According to an additional aspect of the present invention, there is provided a method of manufacturing a tappet in an internal combustion engine, the method comprising the steps of contacting the outer circumferential surface of a core material with a cutting tool to give it feed in an axial direction while the core material is rotated on an axis; giving feed to the cutting tool toward the axis in the vicinity of the end of said core material to form a helical groove which gradually becomes smaller in diameter as it becomes closer to the end of the core material; stopping the feed of the cutting tool when the helical groove reaches to a predetermined position closer to the end of the core material to form an annular groove at then end of the helical groove; covering the outer circumferential surface with a wear resistant coating layer; and finishing the outer circumferential surface of the coating layer to a cylindrical surface, at least said end of the cylindrical surface being chamfered.

The helical groove gradually becomes smaller in diameter toward the end in the vicinity of the end of the core material, thereby preventing the helical groove from being exposed over the coating layer even if the upper and lower ends of the coating layer are chamfered.

The end of the helical groove is stopped before the end of the core material, and is connected with the annular groove, thereby preventing removal even if the chamfered portion is exposed owing to corrosion.

The tappet according to the present invention comprises the core material in which the helical groove is formed on the outer circumferential surface, and the wear resistant coating layer with which the outer circumferential surface is covered and the ends are chamfered, thereby providing a light weight body and relatively small inertia force, so that response and followability to reciprocal movement is improved. Furthermore, owing to wear resistance in frictional portion, durability will increase.

The groove of the core material is completely covered with the coating layer other than upper and lower ends, thereby avoiding thinner string portions as in a conventional ones and removal thereof.

Instead of metal thermal spraying, it is suggested that the core material is immersed in melted metal, or plating is applied, but metal thermal spraying is more convenient and economical.

BRIEF DESCRIPTION OF THE DRAWINGS

The features and advantages of the invention will become more apparent from the following description of embodiments with respect to appended drawings wherein.

DETAILED DESCRIPTION OF THE PREFERRED EMBODIMENTS

Figure 1:
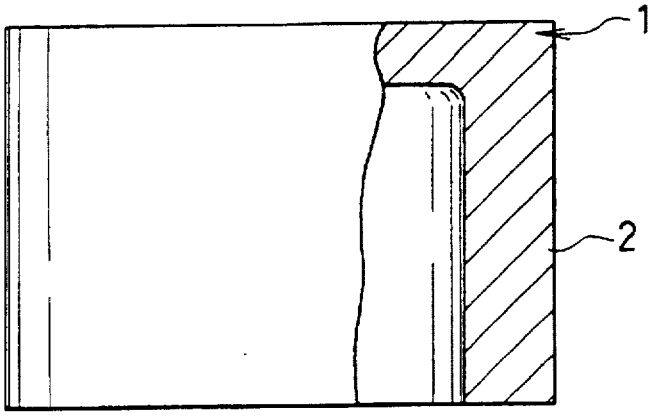
FIG. 1 is a partially sectioned front view of the first embodiment of a tappet according to the present invention.
Figure 2:
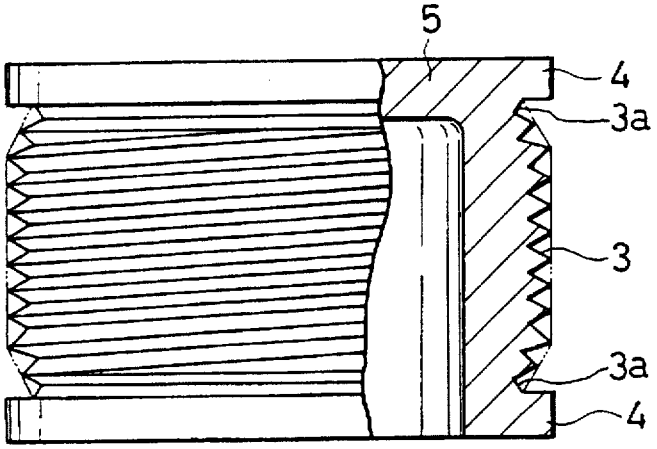
FIG. 2 is a partially sectioned front view which shows a core material in which a helical groove is formed on the outer circumferential surface.

A cylindrical raw material 1 of light metal such as Al as shown in FIG. 1 is rotated on an axis, while a cutting tool contacts the outer circumferential surface 2. Feed is axially given by the cutting tool to form a helical groove 3 on the outer circumferential surface of the raw material 1. At the same time, adjacent to the raw material 1, additional feed is given to the cutting tool toward the axis so that the helical groove 3 gradually decreases in diameter toward the end of the raw material 1.

When the helical groove 3 reaches to a predetermined position which is close to the end of the raw material 1, the feed of the cutting tool is stopped to form an annular groove 3*a* at the end of the helical groove 3, thereby forming a core material 5.

Figure 3:
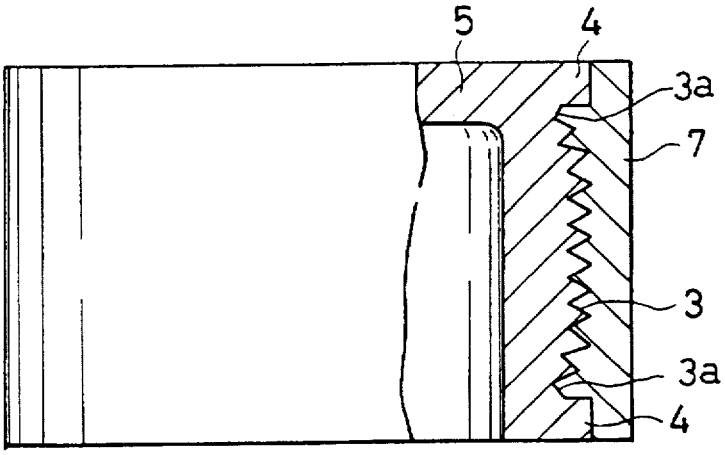
FIG. 3 is a partially sectioned front view in which a coating layer is applied by metal thermal spraying on the outer circumferential surface of the core material in FIG. 2.
Figure 4:
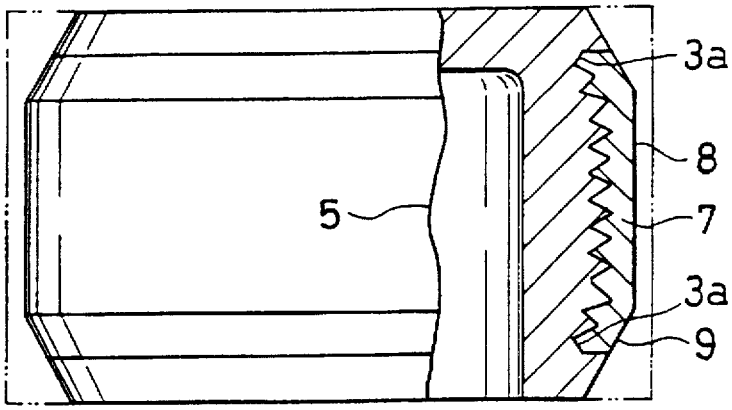
FIG. 4 is a partially sectioned front view of the first embodiment of a finished tappet in which the outer circumferential surface is ground and the upper and lower ends are chamfered to the one in FIG. 3.
Figure 5:
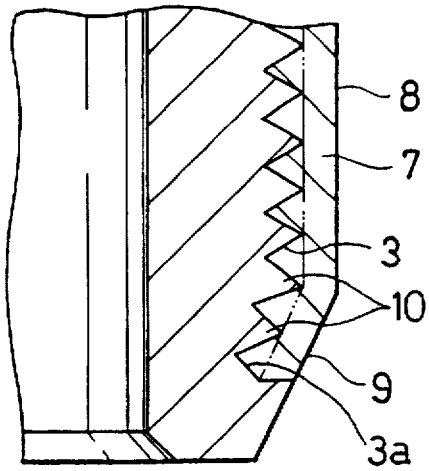
FIG. 5 is an enlarged sectional view of the lower portion of the section in FIG. 4.
Figure 6:
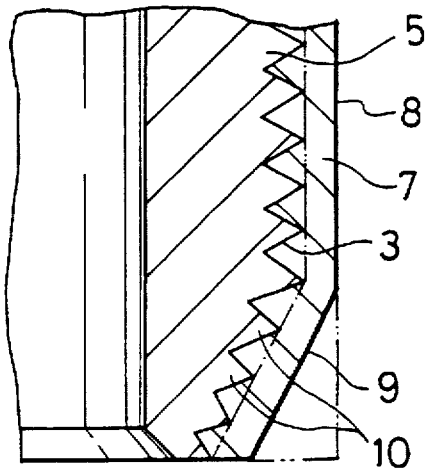
FIG. 6 is an enlarged sectional view of the lower portion in the second embodiment of the present invention.

Then, as shown in FIG. 3, Fe metal is thermally sprayed to all over the outer circumferential surface of the core material 5 to form a wear resistant coating layer 7. Thereafter, as shown in FIG. 4, the outer circumferential surface 8 is ground to form a circumference, and the upper and lower ends are chamfered, thereby forming a tappet as shown in FIG. 5 in the first embodiment. Therefore, peaks 10 in the helical groove 3 of the material 5 are not exposed over the outer circumferential surface 8 of the coating layer 7.

Figure 8:
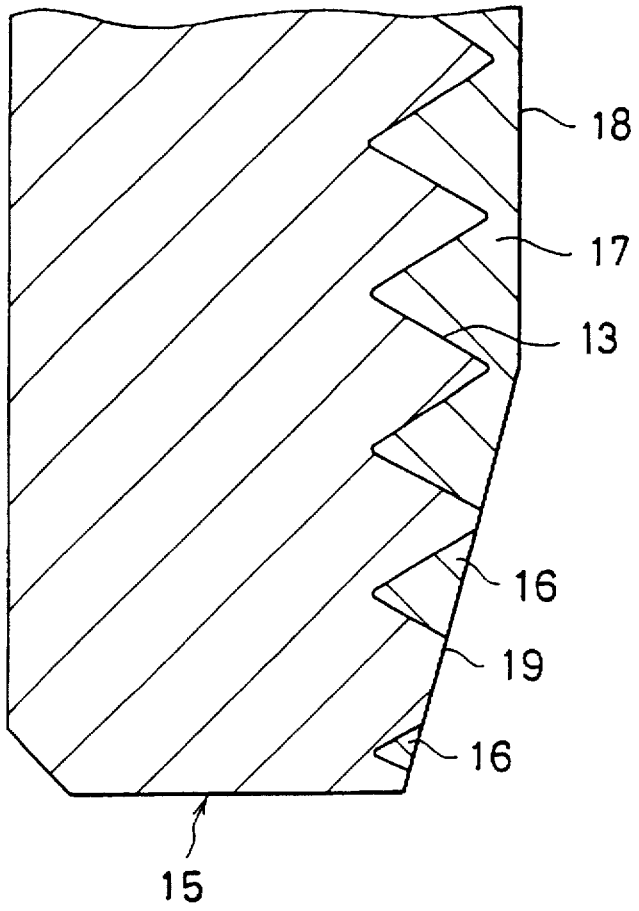
FIG. 8 PRIOR ART
FIG. 8 is an enlarged sectional view of the lower portion of a conventional tappet.
Figure 9:
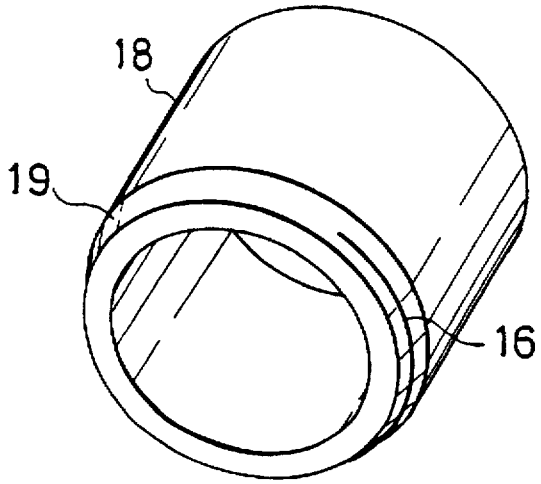
FIG. 9 PRIOR ART
FIG. 9 is perspective view which is seen from one end of the conventional tappet.

FIG. 8 illustrates the second embodiment of a tappet according to the present invention. In the second embodiment, in the vicinity of the end of the raw material 1, feeds are given to the cutting tool in an axial direction and toward the axis, and the raw material 1 is immediately ground to the end thereof without stopping the feeds at near the end of the material 1, so that the helical groove 3 is formed all over the outer circumferential surface 1, and similar way to the first embodiment is then made. The peaks 10 in the helical groove 3 of the material 5 are not exposed over the outer circumferential surface 8 of the coating layer 7. The same numerals are alotted to the same members and parts in the first embodiment, and the details thereof are omitted.

Figure 7:
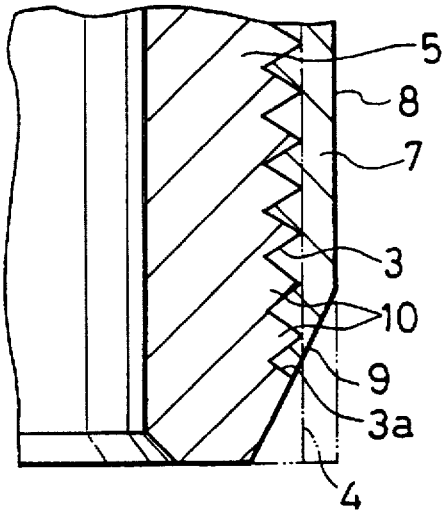
FIG. 7 is an enlarged sectional view of the lower portion in the third embodiment of the present invention.

FIG. 7 illustrates the third embodiment of a tappet according to the present invention. In this embodiment, feed is given to the cutting tool only in an axial direction, not toward the axis, so that the raw material is ground. When the cutting tool reaches to a predetermined position in the vicinity of the end of the raw material, feed of the cutting tool is stopped, and terminates at a position slightly spaced from the end of the material 1, thereby forming a helical groove 3 having an annular groove 3*a* at the terminating end then a tappet is made by a way similar to the first embodiment.

The foregoings merely relate to embodiments of the present invention. Various changes and modifications may be made by person skilled in the art without departing from the scope of claims wherein:

What is claimed is:

1. A method of manufacturing a tappet for an internal combustion engine, comprising the steps of:

rotating a cylindrical core material on an axis of said cylindrical core material;

forming a helical groove on an outer circumferential surface of said core material with a cutting tool;

forming an annular groove at an end of said helical groove in a vicinity of an end of said core material with said cutting tool; applying a wear resistant coating layer on said outer circumferential surface of said core material; and finishing the wear resistant coating layer to a cylindrical surface, wherein at least an end of said wear resistant coating layer is chamfered.

2. The method as recited in claim 1, wherein said finishing step also includes chamfering of said core material.

3. A method of manufacturing a tappet for an internal combustion engine, comprising the steps of:

rotating a core material on an axis:

forming a helical groove which gradually becomes smaller in diameter as it approaches an end of said core material, by applying a cutting tool;

forming an annular groove at an end of said helical groove at a predetermined position close to said end of said core material;

applying a wear resistant coating layer to said core material; and finishing an outer circumferential surface of said coating layer to a cylindrical surface, wherein at least an end of said cylindrical surface being chamfered.

4. The method as recited in claim 3, wherein said finishing step further includes chamfering of said core material.

* * * * *